US007367631B2

(12) United States Patent
Van Dyk

(10) Patent No.: US 7,367,631 B2
(45) Date of Patent: May 6, 2008

(54) METHOD OF AND APPARATUS FOR BREAKING ROCK

(75) Inventor: Andre Van Dyk, Pretoria (ZA)

(73) Assignee: NXCO International Limited, Nassau (BS)

( * ) Notice: Subject to any disclaimer, the term of this patent is extended or adjusted under 35 U.S.C. 154(b) by 0 days.

(21) Appl. No.: 10/880,620

(22) Filed: Jul. 1, 2004
(Under 37 CFR 1.47)

(65) Prior Publication Data

US 2005/0134103 A1 Jun. 23, 2005

Related U.S. Application Data

(63) Continuation of application No. PCT/ZA02/00208, filed on Dec. 17, 2002.

(30) Foreign Application Priority Data

| | | |
|---|---|---|
| Jan. 3, 2002 | (ZA) | 01/5457 |
| Jan. 3, 2002 | (ZA) | 01/5459 |
| Jan. 3, 2002 | (ZA) | 01/5460 |
| Jan. 3, 2002 | (ZA) | 01/5464 |

(51) Int. Cl.
*F42B 3/087* (2006.01)
*E21C 37/12* (2006.01)

(52) U.S. Cl. ..... 299/13; 102/331

(58) Field of Classification Search ..... 299/13, 299/21; 102/331, 333
See application file for complete search history.

(56) References Cited

U.S. PATENT DOCUMENTS

| | | | | |
|---|---|---|---|---|
| 3,235,117 | A * | 2/1966 | Mason, Jr. | 215/256 |
| 3,420,173 | A * | 1/1969 | Slawinski et al. | 102/323 |
| 4,470,352 | A * | 9/1984 | Leperre | 299/13 |
| 5,765,923 | A * | 6/1998 | Watson et al. | 299/13 |
| 6,145,934 | A * | 11/2000 | Arai et al. | 299/21 |
| 6,422,148 | B1 * | 7/2002 | Xu et al. | 102/313 |

OTHER PUBLICATIONS

History of Skipper Ceremonial Cannon of the Virginia Tech Corps of Cadets.htm http://spec.lib.vt.edu/archives/125th/cadets/cannon.htm printed 2007.*

* cited by examiner

*Primary Examiner*—John Kreck
(74) *Attorney, Agent, or Firm*—Jones, Tullar & Cooper, P.C.

(57) ABSTRACT

Apparatus for breaking rock includes a cartridge with a base and a wall which extends from the base, the base and the wall forming an enclosure, a propellant inside the enclosure and means for igniting the propellant, and wherein at least the wall is made from a malleable material adapted to reinforce the wall of a hole in the rock in which the cartridge is located.

19 Claims, 7 Drawing Sheets

212
260
210A
266
270
230
262
272
268
264
220
218
242

354
338
334
332
330
360
362
344
352
342
336
394
350
346
318
310
340

METHOD OF AND APPARATUS FOR BREAKING ROCK

CROSS REFERENCE TO RELATED APPLICATIONS

This application is a Continuation, under the provisions of 35 U.S.C. 120 and 365(c), of International Application No. PCT/ZA02/00208, filed Dec. 17, 2002, which designates the US.

BACKGROUND OF THE INVENTION

This invention is concerned generally with a customized low energy method of breaking rock in a controlled manner.

As used herein the word "rock" includes rock, ore, coal, concrete and any similar hard mass, whether above or underground, which is difficult to break or fracture. It is to be understood that "rock" is to be interpreted broadly.

A number of techniques have been developed for the breaking of rock using non-explosive means. These include a carbon dioxide gas pressurisation method (referred to as the Cardox method), the use of gas injectors (the Sunburst technique), hydrofracturing and various methods by which cartridges containing energetic substances pressurise the walls or base of a sealed drill hole to produce a penetrating cone fracture (known as PCF).

These techniques may be an order of magnitude more efficient than conventional blasting in that they require approximately 1/10 of the energy to break a given amount of rock compared to conventional blasting using high explosives. The lower energy reduces the resulting quantity of fly rock and air blast and to an extent allows the rockbreaking operation to proceed on a continuous basis as opposed to the batch-type situation, which prevails with conventional blasting.

Most non-explosive rock breaking techniques rely on the generation of high gas pressures to initiate a tensile fracture at the bottom of a relatively short drill hole. If the force which is generated by the high gas pressure can be optimally used then the efficiency with which rock is broken is increased.

Higher gas pressure in drilled holes can be achieved by:

1. high density of an energetic substance;
2. high strength of an energetic substance;
3. efficient stemming and sealing of the gas produced in the hole; and
4. a high degree of coupling between the energetic substance and the hole.

The strength and density of the energetic substance in the hole relate to the relative energy per unit volume that is available for pressurising the hole.

Effective sealing of the energetic substance in the hole prevents the gas escaping in two ways.

The first is through the stemming column itself, which therefore relies on efficient stemming material and devices to prevent leakage through or dislodgement of the stemming column.

The second is through the fractures existing naturally in the rock or created by the drilling and breaking process. With existing non-explosive breaking methods the rock starts to fracture when pressurized by the gas, which results in the release of the gas through the fractures. Sometimes the early fracturing of the rock allows the gas to escape before the gas has built up sufficient pressure to displace the rock from its in-situ position, which then prevents the rock from being efficiently excavated.

Coupling is a very important property in achieving high pressures in a drilled hole as a tight interface between the energetic substance and the wall of the hole prevents gas pressure from being dissipated in any space that may exist between the two.

The sealing of the energetic substance in the drill hole and a tight coupling between the energetic substance and the confines of the hole are important factors in the achievement of a high-pressure environment within the drill hole.

Thus, if the gas can be retained in the hole until an optimal pressurization level has been reached and a tight coupling between the energetic substance and the confines of the hole is achieved, the available gas energy can be applied more efficiently to fracture and dislodge the rock in a controlled fashion. An object of the present invention is to achieve such a result.

The manner in which a cartridge is installed in a hole in a rock face, and the nature of the material surrounding the hole, play an important part in determining the efficiency with which the high pressure jet material, released upon ignition of the propellant, is utilised for fracturing the rock body. Stemming of any appropriate type is normally placed in the hole over the cartridge and is tamped down. The stemming acts to retain the cartridge in position when ignition of the propellant takes place. If the stemming is not adequately tamped or for any other reason is not in close contact with the cartridge then its restraining effect is reduced. A similar situation applies in respect of a lower end of the cartridge which, ideally, should be in intimate contact with a bottom of the hole.

In the radial sense the cartridge should be sufficiently small so that it can be inserted into the hole without undue effort. On the other hand the gap between an outer surface of the cartridge and an opposing surface of the wall of the hole should not be unduly large.

If a hole is formed in a rock mass which is partially fractured or fissured then the effectiveness of the energy, which is released upon ignition of the propellant in a cartridge, is reduced. This reduced effectiveness occurs for at least two reasons:

(a) firstly, the joints and fractures in the rock surfaces adjacent the cartridge allow the gas to be dissipated without directing the full amount of available energy into rock breaking; and (b) secondly, the dissipation of the gas into the joints and fissures reduces the rate of pressurisation of the hole which in turn, as the burn rate is a positive function of the degree of confinement of the propellant, reduces the burn rate of the propellant and hence the rate at which gas is produced by the burning propellant.

The combination of the reduced rate of production of gas and the dissipation of the gas into the joints and fissures of the hole results in a reduced pressure environment in the hole which may be insufficient to break the rock.

Thus, if the gas can be retained in the cartridge until an optimal pressurisation level has been reached, the loss of effectiveness due to dissipation and reduced rate of gas production can be minimised.

Conversely, if the pressurisation of the cartridge is too high, the eventual release of the gas will cause the rockmass to break with resultant adverse side effects such as excessive flyrock, high levels of noise and increased overpressure or air blast effects.

SUMMARY OF INVENTION

The invention provides a method of breaking rock which includes the steps of:

(a) placing a gas-evolving substance into a cartridge having a malleable wall adapted to reinforce the wall of a hole in the rock;

(b) loading and confining the cartridge in the hole;

(c) initiating a reaction of the gas-evolving substance to cause the wall of the cartridge to expand under pressure of the gas to the contours of its confinement and thus reinforce the wall of the hole; and (d) allowing a further build-up of pressure within the cartridge until rupture of the malleable wall and dislodgement of rock from the reinforced wall of the hole are achieved. Stemming material of any appropriate kind may be placed in the hole over the cartridge in a manner which is known in the art.

The cartridge may be allowed to rupture at least at one predetermined point or zone, as the pressure of the gas confined within the cartridge increases.

"Malleable" in the sense as used herein includes a material which is capable of plastic deformation, without rupture, at least to the point at which the cartridge is in intimate contact with the surrounding wall of the hole.

The cartridge may include an upstanding wall which may be generally cylindrical, mounted to a base.

In step (c) the cartridge may be allowed to expand in a radial sense into sealing engagement with a wall of the hole surrounding the cartridge. The cartridge is preferably also allowed to expand in a longitudinal sense in the hole.

The cartridge may include a base which is moved onto intimate engagement with a bottom of the hole in which the cartridge is located, when the cartridge expands in the longitudinal direction.

An end of the cartridge which is remote from the base may be surrounded by stemming and the end may be caused to move into close contact with the stemming as the cartridge expands in the longitudinal direction.

The cartridge may include at least two portions which are allowed to move relatively to one another to allow the cartridge to expand in the longitudinal direction.

The portions of the cartridge may be in sliding and sealing engagement with one another.

The cartridge may include a rupture valve and the method may include the step of allowing the valve to rupture prior to the side wall whereby, at least initially, fracture of rock is initiated at a bottom of the hole.

The rupture valve may be slidingly or telescopically movable relative to the side wall thereby to expose open or weakened regions of the valve which allow pressurized material to escape from the cartridge before the side wall ruptures or breaks.

The method may include the steps of assessing characteristics of the rock, matching at least one parameter of the cartridge to the rock characteristics, and initiating the propellant to achieve a desired rock-breaking effect which is dependent on the at least one parameter.

In the context of the aforementioned method, the word "parameters" is to be interpreted broadly and includes at least the following: the nature, ie. composition, of the propellant; the quantity of the propellant; the physical parameters of the cartridge, ie. the material from which the cartridge is made, its shape and size; the ability of the cartridge or a component which is associated with the cartridge to deform a pressure wave which is generated upon initiation of the propellant; the use of high density material to produce high density jet material upon initiation of the propellant; the inclusion or provision of discontinuities in the cartridge to create high stress concentration points; and similar parameters and mechanisms.

The characteristics of the rock may be assessed in step (a) using techniques which are known in the art but the invention is not limited in this regard. The rock may be characterised, for example, by reference to its mineral content, quality and its strength. Other aspects which can be taken into account include joint counts, the directions of joints, the number and size of fissures in the rock, and the like.

As indicated the propellant is initiated to achieve a desired rock breaking effect. For example it may be desirable to release a predetermined quantity of rock in a given direction. It may further be required to fragment the rock into particles at least of a particular size and to reduce, as far as is possible, the generation of fines. Requirements of this type are known in the art and generally are dictated by external factors. For example it is desirable to restrict the production of fines to lower the risk of an inadvertent explosion, to reduce air conditioning requirement and the generation of toxic gases, and the like.

The sizes of the rock particles which are required to be released by the rock breaking method may be determined by subsequent processing techniques eg. milling, combustion, handling and similar factors which are dependent at least on the nature of the material which is being mined or broken.

In the method of the invention the cartridge may be caused to fracture at least at one predetermined point or zone as the pressure of the material inside the cartridge increases.

The invention also provides apparatus for breaking rock which includes a cartridge with a base and a wall which extends from the base, the base and the wall forming an enclosure, a propellant inside the enclosure and means for igniting the propellant, and wherein at least the wall is made from a malleable material adapted to reinforce the wall of a hole in the rock in which the cartridge is located.

The malleable material may be metallic or plastics and, in the latter case, use may be made of a high-density material. An important aspect in this regard is that the plastics material must be capable of plastic deformation, without rupturing, by a predetermined extent, eg. of the order of 10% to 20%. By way of a non-limiting example if the enclosure is circular cylindrical with a diameter of the order of 30 mm to 33 mm then the enclosure should be plastically deformable, in a radial sense, to an increased diameter of the order of 35 mm to 38 mm.

It is important that the malleable material should be rigid enough so that it can be inserted into the hole, and placed at a desired position.

The plastics material may be a copolymer material.

The plastics material may be selected from high density polyethylene, low density polyethylene, and polypropylene.

A weakened zone may be formed at a junction of the wall and the base and the design may be such that when the cartridge is internally pressurized the container ruptures initially at this junction.

The cartridge may have at least two portions, forming an enclosure for a propellant, which are movable relatively to each other.

The cartridge may be elongate and the portions may be movable in a longitudinal direction relatively to each other.

In one embodiment the cartridge includes a rupture valve and pressurized material, released upon ignition of the propellant, is allowed to escape from the cartridge via the rupture valve, at least initially, prior to escaping through the side wall.

The rupture valve may form a base for the cartridge and the pressurized material may escape from the cartridge at a region which is adjacent the base or which is initially occupied by at least part of the base.

The rupture valve is preferably telescopically engaged with the side wall which may be of tubular shape.

In one example of the invention a friction zone or region, between the base and the side wall, may be provided in the cartridge to facilitate rupture of the valve at a predetermined pressure, prior to rupture of the side wall. Gas releasing vents may be provided to allow release of the pressurized material once the valve has been extended sufficiently from within the confines of the side wall.

As used herein "propellant" is to be interpreted broadly to include a propellant, a blasting agent, a gas-evolving substance or similar means which, once initiated, generated high pressure combustion products typically at least partly in gaseous form. Propellants of this nature are known in the art. Propellant and gas-evolving substance are used interchangeably.

BRIEF DESCRIPTION OF THE DRAWINGS

The invention is further described by way of examples with reference to the accompanying drawings in which.

DESCRIPTION OF PREFERRED EMBODIMENTS

Figure 1:
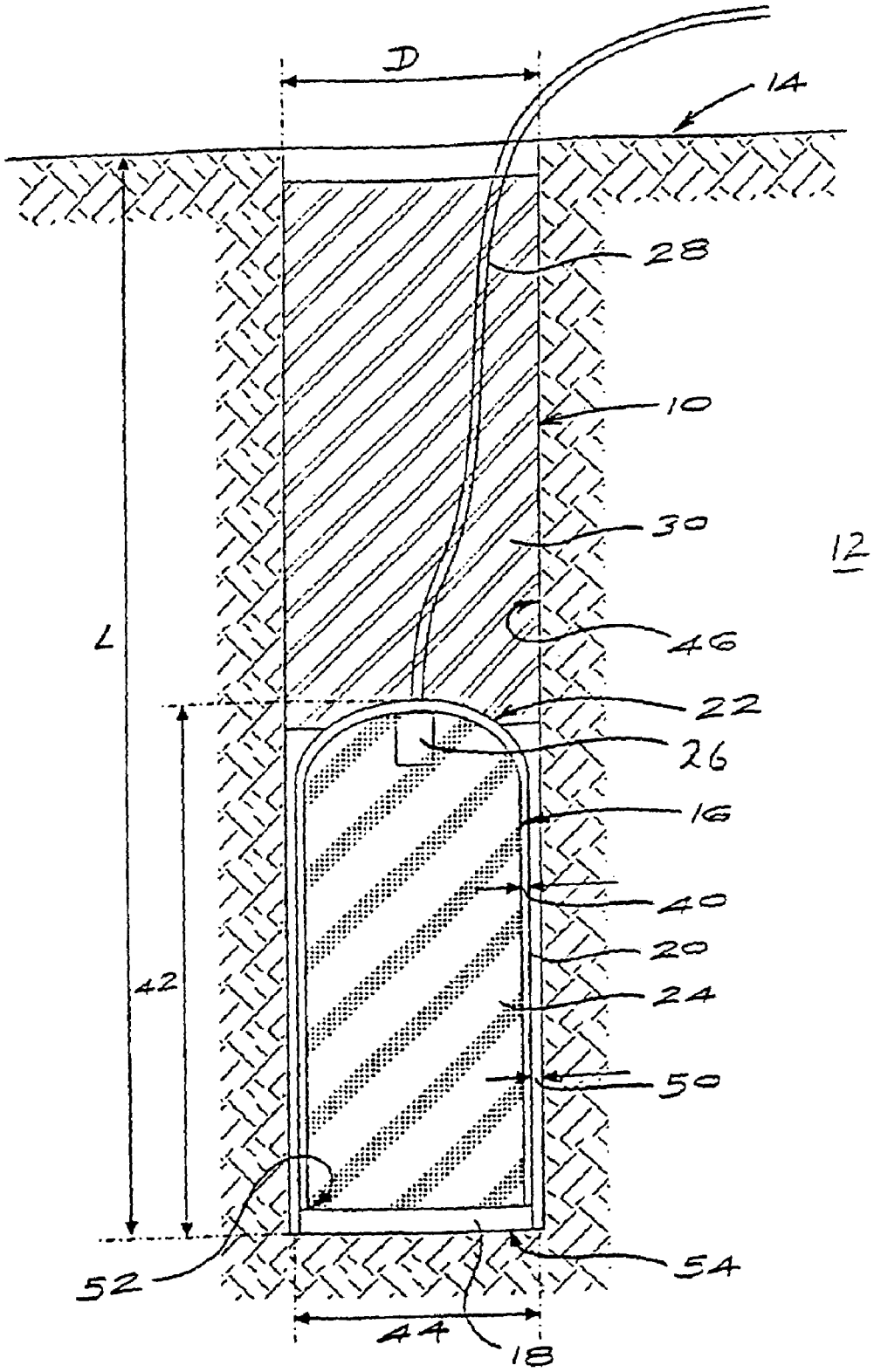
FIGS. 1 to 4 respectively illustrate somewhat schematically and from the side in cross section the use of a method of breaking rock according to different forms of the invention.

FIG. 1 of the accompanying drawings illustrates a hole 10 which is drilled into a rock mass 12 from a face 14 using conventional drilling equipment, not shown. The hole is drilled to a length L which is at least four times the diameter D of the hole.

A cartridge 16 according to the invention is loaded into the hole. The cartridge has a base 18 and a generally cylindrical wall 20 which extends upwards from the base and which, at an end which is remote from the base, has a rounded shape 22.

The base 18 is substantially more robust than the wall 20. This may be achieved by making the base 18 substantially thicker than the wall 20 or by making the base from an inherently stronger material than the wall. It is also possible to make use of both techniques.

At least the wall 20 is made from a malleable material which, as indicated earlier in this specification, means a material which is capable of plastic deformation without rupture at least to a predetermined extent. By way of example at least the wall 20 may be made from a high-density plastics material such as high-density polypropylene.

The cartridge 16 forms an enclosure for a propellant material 24 which is of known composition. The propellant is loaded into the cartridge under factory conditions using techniques which are known in the art. An initiator 26 is loaded into the cartridge, preferably on site. As shown in the drawing the initiator is located at the rounded upper end 22 but this is by no means limiting and the initiator can be loaded into the cartridge at any appropriate point.

Control wires 28 lead from the initiator to a unit, not shown, which is used in a known manner for initiating the cartridge.

Stemming 30 is placed into the hole 10 from the rock face 14 covering the cartridge to a desired extent. The stemming can be pneumatically, mechanically or manually tamped in position. The nature of the stemming and its manner of use are known in the art and for this reason are not further described herein.

The wall 20 of the cartridge 16 has a thickness 40 and a length 42. The former parameter is determined at least by the nature of the material from which the wall is made and its plasticity properties, and the strength which the cartridge must possess, during use. The length of the wall is a primary factor in determining the volume of propellant 24 held in the container which in turn determines the amount of energy which is released when the propellant is ignited.

The cartridge has a diameter 44 which is slightly less than the nominal diameter D of the hole. It should be possible to place the cartridge into the hole without the cartridge becoming frictionally jammed against the wall 46 of the hole. On the other hand it is desirable for the cartridge to fit fairly intimately into the hole so that an annular clearance gap 50 between the cartridge wall 20 and the hole wall 46 is relatively small eg. less than 2 mm.

Depending on the drilling technique and equipment used the diameter D may vary in size from 8 mm to 102 mm and the cartridge 16 is sized accordingly.

Ignition of the propellant 24 by the initiator 26 causes the release of high-pressure combustion products which are substantially in gaseous form. The cartridge 16 is designed to contain the expanding high pressure gas and for this reason is allowed to deform outwardly, without rupturing, so that the wall 20 of the cartridge is forced into intimate sealing contact with an opposing surface of the wall 46 of the hole. The cartridge does not rupture during this process for, as noted, it is fabricated from a plastically deformable material.

The cartridge consequently confines the high pressure gas and the wall 20 of the cartridge, once it is in close contact with the wall 46 of the hole 10, effectively reinforces the wall of the hole.

The situation should be contrasted with what prevails when the cartridge wall 20 fractures before it is in contact with the wall of the hole 46. In this instance the high-pressure combustion products, which are able to escape from the cartridge, come into direct contact with the wall 46. As the high pressure combustion products are substantially gaseous in nature they are able to escape into micro-fissures or cracks in the wall 46 thereby leading to a loss of energy which, in turn, translates into a reduction of the maximum force which is generated on the wall 46.

By confining the high pressure combustion products inside the cartridge it becomes possible to cause the cartridge to rupture at a desired point or region which means that the force which is released by the propellant can then be directed onto a chosen surface of the wall of the hole adjacent the point or region of the cartridge which is adapted first to rupture.

In the illustrated embodiment the base 18 is robust, compared to the wall 20 and the deformation of the base, relatively to the wall, is slight. A discontinuous region is therefore formed at a junction 52 between the base and the upstanding wall 20. This junction is essentially right-angled.

The junction acts as a stress release point and the cartridge thus initially ruptures at this point causing the release of the high pressure contents of the cartridge into the bottom of the hole 10 which, itself, is discontinuous at the junction of the side wall 46 with the bottom 54 of the hole. Rock failure is induced in this high stress area which results in crack propagation through the rock and effective rock breaking.

An important aspect of the invention therefore lies in the ability of the cartridge to deform plastically to confine expanding high-pressure combustion products released by the ignited propellant in such a way that the cartridge reinforces the surrounding wall of the rock and prevents premature escape of the high pressure combustion products. This means that the rock can be caused to break in a tailored manner: not in a manner which depends solely on the joint or discontinuity characteristics of the rock, but rather in a way which is dependent upon the design parameters of the cartridge.

Figure 2:
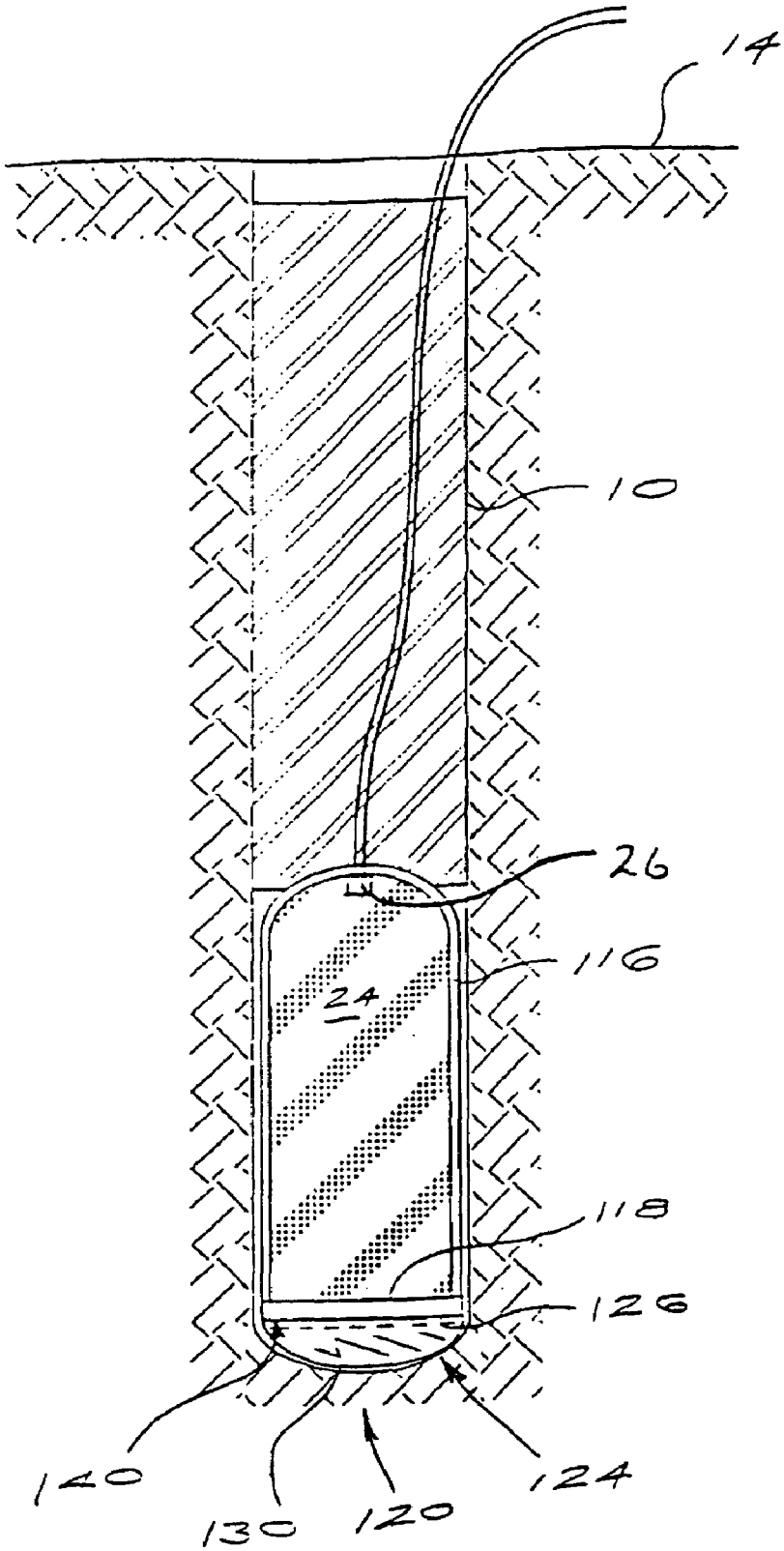

FIG. 2 illustrates a modification to the arrangement shown in FIG. 1. A cartridge 116, which is generally of the type which has been described hereinbefore, is positioned in a hole 10 in a rock face 14. The hole has a bottom designated 120 which has rounded corners 124 which result either from poor drilling technique or from wear on the drill bit which is used to form the hole. Ideally the corners should be right angled in profile as is shown by means of a dotted line 126.

The force which is exerted by the propellant 24 in the cartridge, when the propellant is ignited, is transferred to the base 118 of the cartridge. In order to create fracture points at the bottom 120 it is desirable for the bottom to have the dotted line profile 126. As reaming of the hole may be an unnecessarily expensive and time consuming process it is rarely resorted to.

The invention provides a "false" right angle bottom to the hole by making use of a mouldable or settable material 130 which is placed on the bottom 120 below the base of the cartridge. As the material is deformable and as the underside of the base of the cartridge is essentially planar the mouldable material provides a right angled transition between the cartridge and the bottom of the hole. This ensures that a right angled discontinuous junction 140 is formed at the interface of the side wall of the hole and the upper surface of the material 130. This promotes fracture of the rock in the region of the bottom in a more efficient manner.

Figure 3:
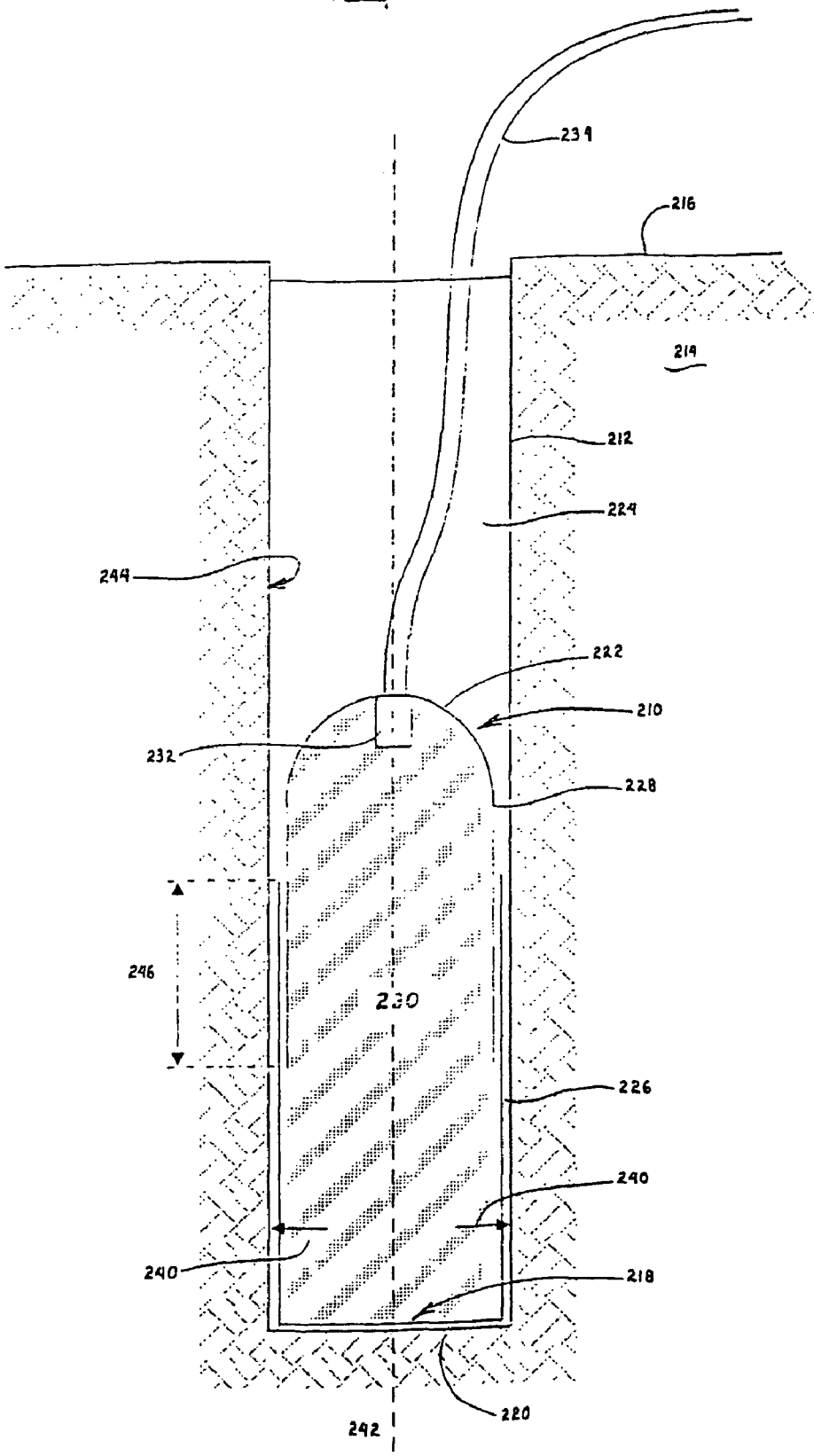

FIG. 3 of the accompanying drawings illustrates another embodiment of the invention.

The cartridge 210, in this example, is made from two portions 226 and 228 respectively. Each portion is generally circular cylindrical and the portion 226 extends over the portion 228 with a sliding fit. The base 218 forms a sealed end of the portion 226 with its opposing upper end (in the drawing) being open.

The domed end 222 forms a closure for the portion 228 and its opposing lower end (in the drawing) is open and forms a mouth over and around which the portion 226 extends.

A propellant 230 is contained inside the enclosure formed by the portions 226 and 228.

An initiator 232 is engaged with the domed end 222 of the cartridge. Control wires 234 extend from the initiator to a control unit, not shown, which is used for igniting the initiator which in turn ignites the propellant.

The portions 226 and 228 of the cartridge are made from a malleable material which is capable of plastic deformation, at least to a predetermined extent, in a radial direction which is indicated by means of arrows 240 and which is transverse to a longitudinal axis 242 of the hole.

When the propellant 230 is ignited high pressure jet material which is primarily of a gaseous nature is released. The cartridge 210 acts to confine the high pressure jet material and helps to prevent the unwanted escape of this material into the hole 212. At least initially the high pressure material causes the portions 228 and 226 to expand in the radial direction 240 so that the walls of the portions are forced into close sealing contact with the surrounding surface 244 of the wall of the hole 212. The regions of the two portions 228 and 226 which overlap with each other, and which are designated by a double-headed arrow 246, despite being in sliding contact with each other, are also urged into sealing contact with each other so that the escape of the high pressure material through the interface between these overlapping portions is minimised.

On the other hand the fact that the cartridge is made from two relatively slidable sections means that the cartridge is capable of extending in a longitudinal direction which is substantially coincident with the axis 242 and which is transverse to the radial direction 240. The two cartridge portions slide over one another and the base 218 is thereby brought into close contact with the bottom 220 of the hole while the domed upper end 222 is urged into close contact with the surrounding stemming 224.

It follows that, at least initially, the expanding nature of the cartridge acts to confine the high pressure jet material which is generated upon ignition of the propellant 230. Premature loss of the high pressure material into the hole 212 is thus reduced. This high pressure material could, for example, otherwise escape into micro-fissures or cracks in the wall 244 of the hole, a factor which would reduce the utilisation efficiency of the energy which is released by the propellant.

The cartridge 210 reinforces the wall of the hole 212. The cartridge can be designed to rupture substantially at the same time as the surrounding mass of rock 214. It is also possible to design the base 218 so that a shaped wave of high pressure jet material is emitted from the base onto the hole bottom 220 or downwardly and outwardly at the base more or less at the junction of the side wall of the portion 226 and the base 218.

Figure 4:
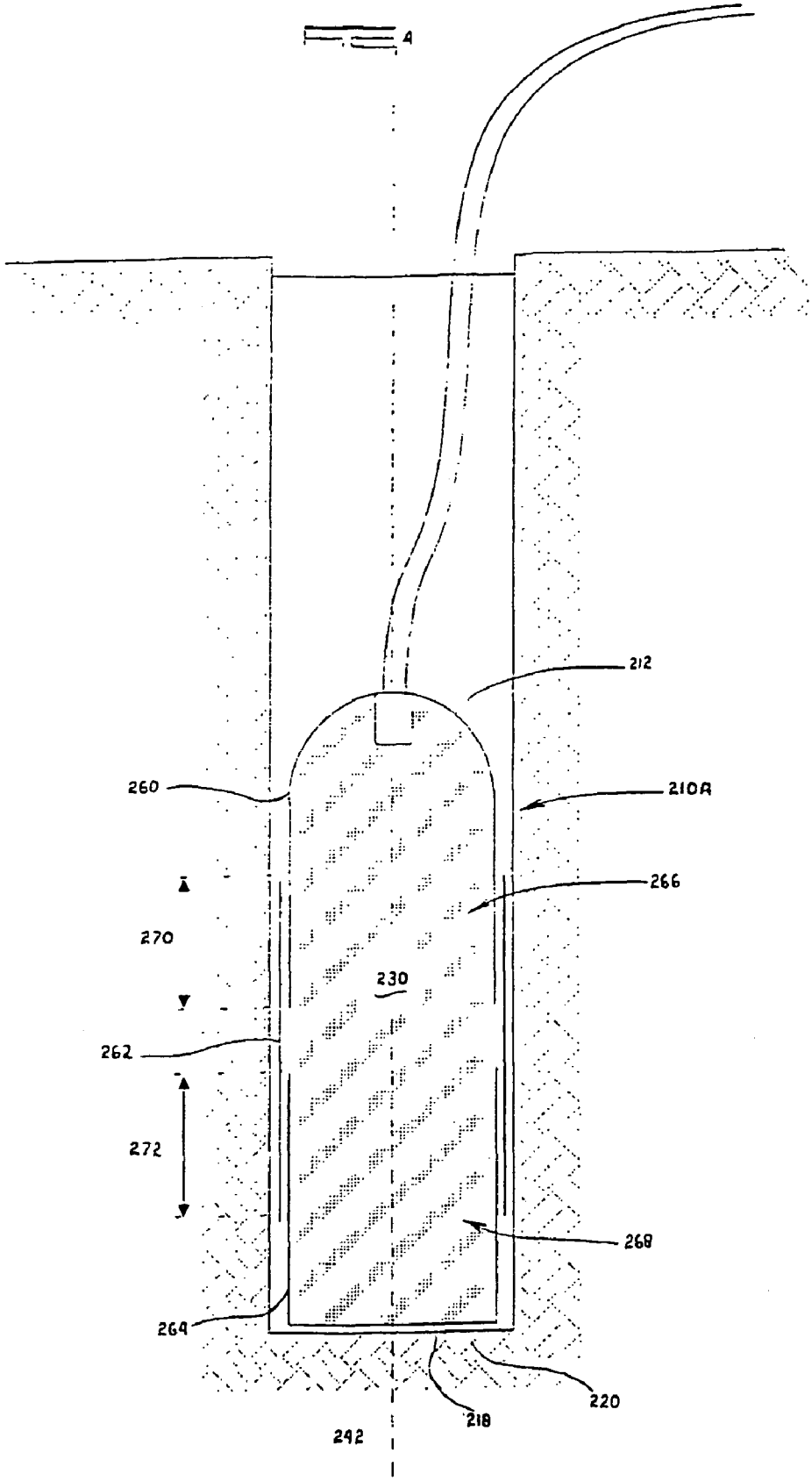

FIG. 4 illustrates an arrangement which, in many respects, is similar to what is shown in FIG. 3 and thus, where applicable, like reference numerals are used to designate like components. The following description relates only to the points of difference.

The cartridge shown in FIG. 4, designated 210A, includes three portions designated 260, 262 and 264 respectively. The portions 260 and 264 are generally similar to the portions 226 and 228 shown in FIG. 3. Thus the upper portion 260 has a domed end 212 while the lower portion 264 has a base 218 which opposes a bottom 220 of the hole.

The intermediate portion 262 is circular cylindrical in shape and has open upper and lower ends 266 and 268 respectively. The portions 260 and 262 are in relative sliding contact with one another over an overlapping region 270 while the portions 262 and 264 are in relative sliding contact with each other over an overlapping region 272.

When the propellant 230 is ignited the cartridge 210A expands in a radial sense substantially in the manner which has been described in connection with FIG. 3. The cartridge 210A also expands in a longitudinal direction ie. generally in the direction of a longitudinal axis 242 of the hole 212 but in this case is capable of a greater degree of longitudinal movement than the cartridge 210. The longitudinal expansion arises from relative movement between the portions 260 and 262 on the one hand, and between the portions 262 and 264, on the other hand. The overlapping portions in the regions 270 and 272 are effectively sealed and prevent the escape of the high pressure material while allowing the longitudinal extension of the cartridge. The cartridge is urged into sealing contact with a surrounding wall of the hole and, as before, helps to confine the high pressure material preventing its premature release and dissipation, factors which can result in a reduction in the efficiency of utilisation of the propellant.

Figure 5:
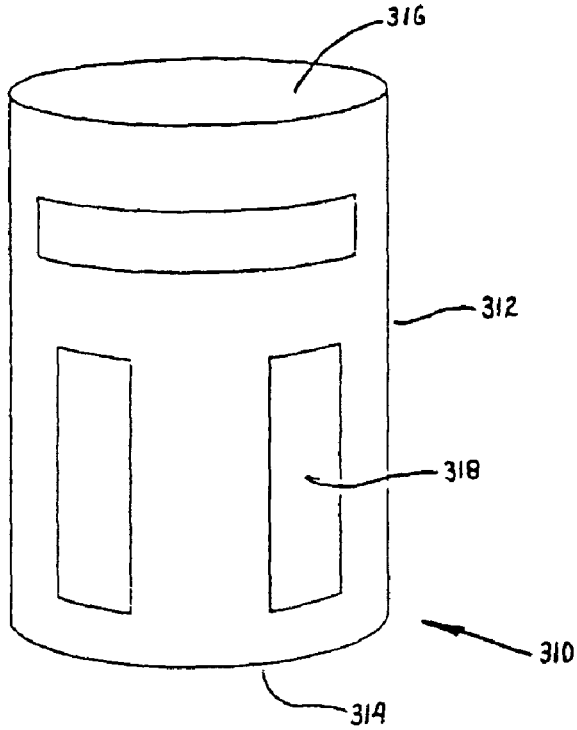
FIG. 5 is a side view of a rupture valve according to one form of the invention.

FIG. 5 illustrates a cup-shaped component 310 which has a cylindrical side wall 312, a base 314 and a mouth 316. The side wall is formed with strategically placed and shaped slots 318. The component 310 is made from an appropriate plastics material eg. polypropylene.

Figure 6:
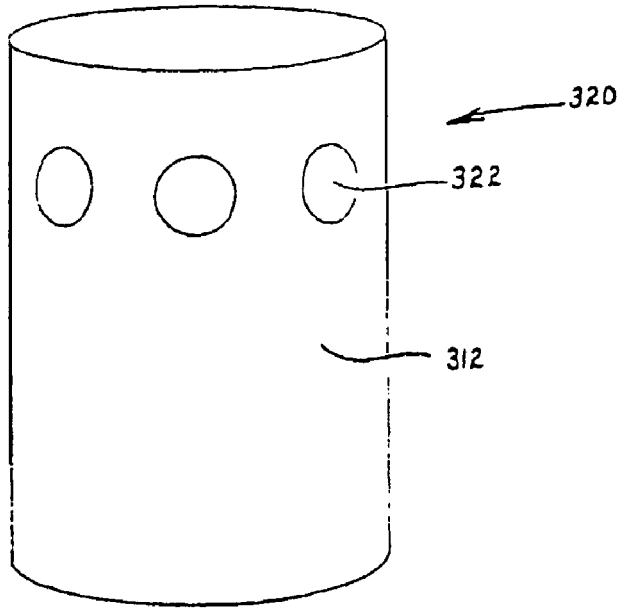
FIG. 6 is a side view of a rupture valve according to another form of the invention.

FIG. 6 shows a component 320 which is similar in shape and size to the component 310 but wherein the slots 318 (in FIG. 5) are replaced by a plurality of holes 322 which are positioned at selected locations in the side wall 312 of the component.

Figure 7:
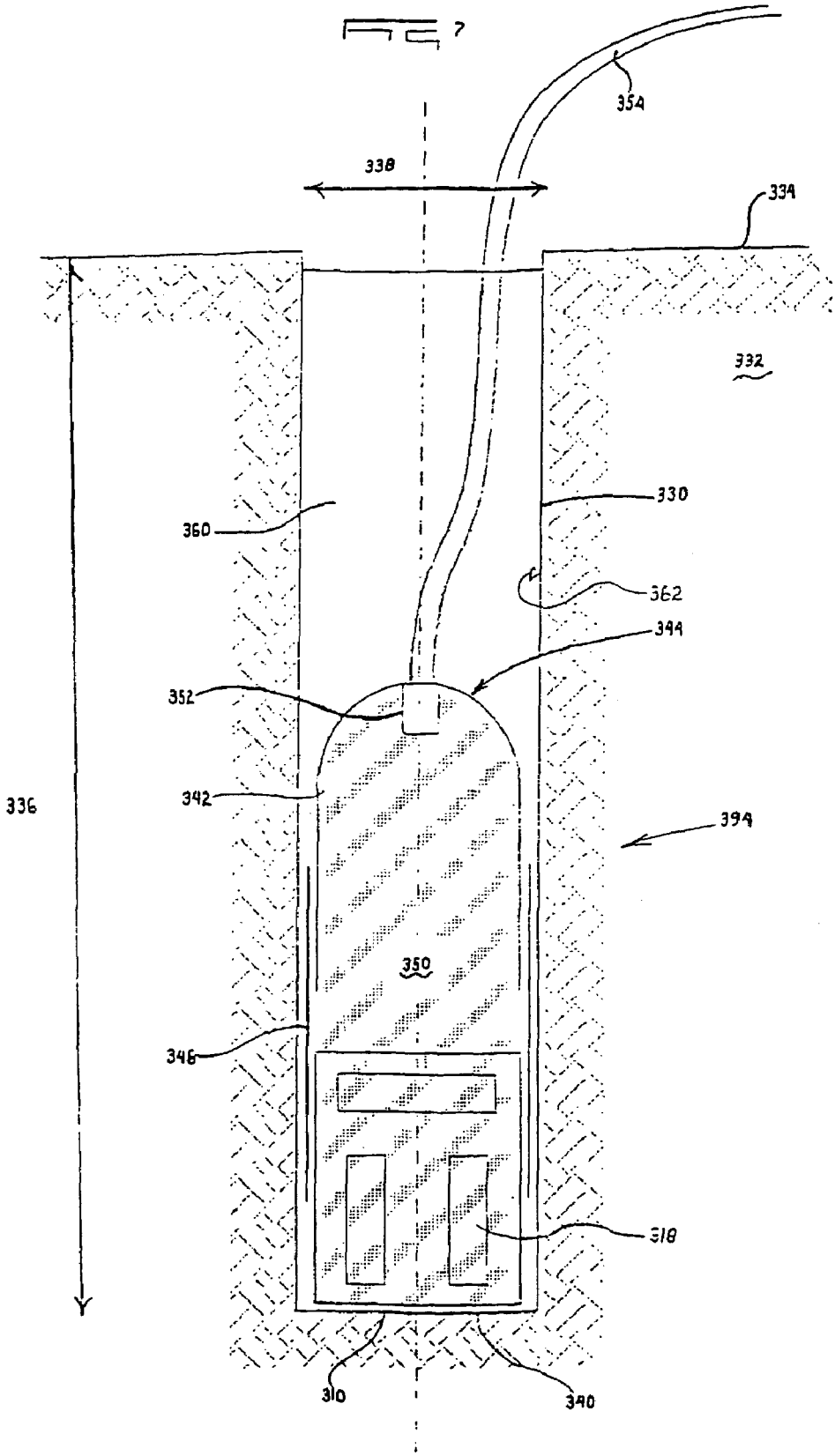
FIG. 7 illustrates the use of the rupture valve of FIG. 5 in a cartridge, for the breaking of rock.

FIG. 7 illustrates from the side and in cross section a hole 330 which is formed in rock 332 by drilling from a rock face 334 using conventional equipment and techniques which are not further described herein.

The hole is drilled to a desired length 336 and has a nominal diameter 338.

The rock 332 has characteristics which are determined principally by its physical composition although these characteristics may have been affected by blasting or excavation which has previously taken place in the vicinity of the rock. Thus, for a variety of reasons, the integrity of the rock may be reduced in that it may include micro-fissures, cracks, discontinuities or the like which, for the reasons already described, can reduce the effectiveness of rock breaking techniques.

The present invention is concerned with initiating further fracture of the rock 332 in the region of a bottom 340 of the hole. To achieve this a cartridge 342 is placed in the hole 330. The cartridge has a domed upper end 344 and a side wall which forms a cylindrical intermediate portion 346. A component 310 of the kind shown in FIG. 5 is telescopically engaged with a lower end of the intermediate portion 346.

A propellant 350 of known composition is located in the cartridge and an initiator 352 of known construction is engaged with the container. Control leads 354 lead to a remote control unit, not shown, which is of known construction and which is used to energise the initiator.

The length and diameter of the cartridge determine the amount of propellant 350 held in the cartridge. This in turn is related using data known in the art to the composition of the mass of rock 332, the depth 336 of the hole and similar factors.

Stemming 360 is placed in the hole 330 over the cartridge 342 to a desired extent and is then firmly tamped down.

When the propellant 350 is ignited a high pressure material, which is primarily of a gaseous nature, is released. The cartridge is contained by the stemming and rapidly expands radially outwardly and downwardly so that the side wall 346 is brought into intimate contact with an opposing surface of a wall 362 of the hole. The cartridge 342, as it is made from a malleable material, is capable of plastically expanding without fracturing and so acts as a gas seal which ensures that the high pressure jet material inside the cartridge does not, at least initially, escape into micro-fissures and cracks in the surrounding mass of rock.

The side wall 346 thus initially acts to reinforce that portion of the surface of the wall 362 of the hole which surrounds the cartridge.

As the component 310 moves out of the intermediate portion 346 the slots 318 in the side wall of the component protrude from the intermediate portion to a greater extent and consequently act as gas releasing vents which allow the gas to escape into the interior of the hole. As has been noted this release takes place particularly near the bottom 340 of the hole and breaking of the rock mass, in this region, is effectively promoted.

The component 310 can be replaced by a component 320 of the type shown in FIG. 6 or, for that matter, by any other suitable component which has gas releasing vents of a suitable size, shape and position to ensure that effective rock breaking is promoted at the bottom of the hole.

Figure 8:
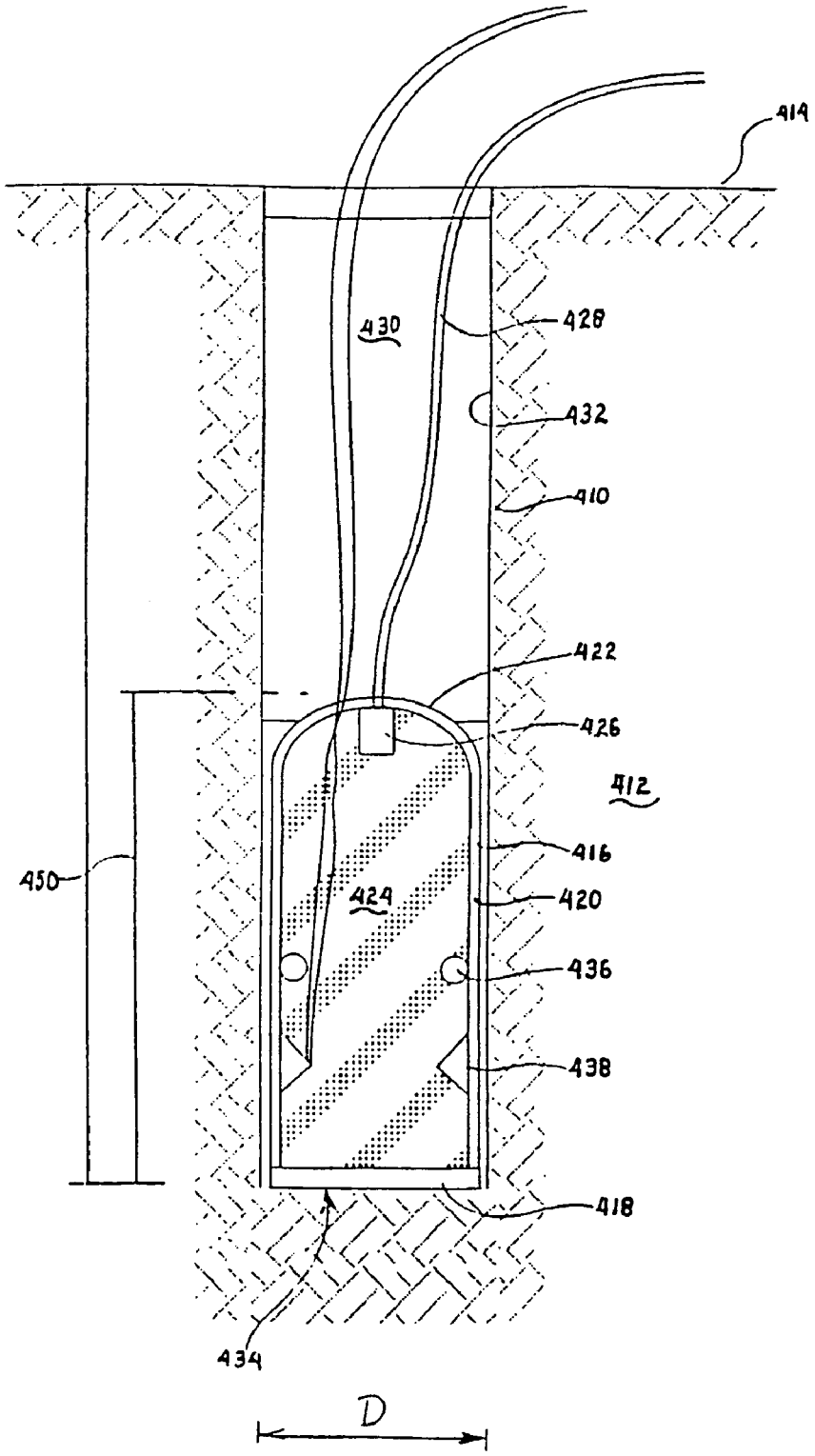
FIG. 8 shows another embodiment of the invention.

FIG. 8 illustrates a hole 410 which is drilled into a rock mass 412 from a face 414 using conventional drilling equipment, not shown. The hole is drilled to a length L which is at least four times the diameter D of the hole.

A cartridge 416 is loaded into the hole. The cartridge has a base 418 and a generally cylindrical side wall 420 which extends from the base and which is terminated at an upper end in a rounded shape 422.

The cartridge 416 is made from a malleable material which, as indicated, means a material which is capable of plastic deformation, without rupture, at least to a predetermined extent, eg. at least by 10%.

The cartridge 416 forms an enclosure for a propellant material 424 which is of a known composition and which is loaded into the cartridge under factory conditions using techniques which are known in the art. An initiator 426 is loaded into the cartridge.

Control wires 428 lead from the initiator to a unit, not shown, which is used in a known manner for initiating the blasting process.

Stemming 430 is placed into the hole 410 from the rock face 414 to cover the cartridge to a desired extent. The stemming is tamped or otherwise consolidated into position. The nature of the stemming and its manner of use are known in the art and for this reason are not further described herein.

The cartridge has a diameter which is slightly less than the nominal diameter D of the hole. It should be possible to place the cartridge into the hole without the cartridge becoming frictionally jammed against the wall 432 of the hole. The cartridge should fit fairly intimately into the hole so that the size of a clearance gap between an outer surface of the cartridge and the wall surface 432 is minimal. It is also desirable for the base 418 to be in close contact with a bottom 434 of the hole.

In this example of the invention the cartridge includes a pressure wave deforming ring 436, of a suitably dense material, positioned inside the cartridge at a predetermined location. The cartridge further includes a ring 438 of high-explosive material which is attached to an inner surface of the wall 420.

"Propellant" is to be distinguished from an "explosive" or "high-explosive". Each of the latter terms, which are used interchangeably herein, means an energetic substance which gives rise to an explosive shock wave which results from a more rapid detonation or combustion of the energetic substance, than that which occurs with the propellant.

Prior to the cartridge being loaded into the hole the nature of the rock 412 is assessed. This can be done using techniques which are known in the art and which, inter alia, can include a determination of the rock mass, its strength, its density and the like. An indication of the rock quality can also be obtained by counting joints in the rocks, determining the directions of the joints, the incidence of micro-fissures, and any other physical parameters which relate to the quality or integrity of the rock mass. These techniques allow the rock quality to be designated and for the rock to be classified in accordance with its mass.

A further factor which is taken into account in the selection of the cartridge relates to the characteristics of the rock which is to be broken from the rock mass 412 by initiation of the blasting agent 424. For example in the mining of coal it is highly desirable to reduce the incidence of fines and to produce coal pebbles of at least a particular size. Similarly in the mining of gold-bearing ore the incidence of fines should be minimized for this can result in a substantial loss of gold content. Factors of this type are known in the art and are taken into account when determining the parameters of the cartridge 416.

When the propellant is detonated by the initiator 424, a pressure wave is formed which propagates down the cartridge. The pressure wave expands the cartridge into intimate contact with the wall 432 of the hole and, at least initially, confines the high pressure jet material preventing its premature escape into fissures or cracks in the rock body.

The pressure wave impacts the base 418 and gives rise to forces which are considerably in excess of the compressive strength of the rock.

The forces which are developed at the bottom of the hole cause compressive stresses in the rock, near the bottom, and cause tensile hoop stress in the rock wall near the hole bottom. A region of complex tensile and shear stresses, is created and this causes the rock 412 to fracture by crack propagation and to be broken free from the rock body.

An objective of the invention with this embodiment is to match the parameters of the cartridge to the assessed characteristics of the rock, taking into account the desired rock breaking effect which is produced by the ignited cartridge. This may be achieved by using one or more of the techniques which are described hereinafter.

In general the propellant 424 will not form a sufficiently concentrated detonation wave to cause what is known as a classical shaped charge effect. The strong directed pressure waves resulting from the propellant can however be used to accelerate a metal or plastics material to sufficiently high velocities, with sufficient precision, to ensure that the accelerated material can create a zone of considerable damage in the rock around the periphery of the bottom 434. The base 418 may thus be enhanced and can be made from a thicker material than the wall 420. Alternatively the base is made from a stronger or more massive material than the wall. This will give rise to a zone of considerable damage in the rock around the periphery of the bottom and create a substantial region of complex tensile and shear stresses.

The propellant 424 clearly has a significant effect on the rock fracturing process. The propellant may be selected from an emulsion explosive, ANFO explosive, and a deflagrating propellant.

The localised stress fracture points, which can be matched to the rock characteristics, can be generated during the combustion process to enhance the breaking of the rock according to requirements. The ring 436, inside the propellant 424, acts to deform the pressure wave which is generated by combustion of the propellant and give rise to high stress concentrations in the region of the ring. Consequently breaking of the rock can be initiated at a selected point in the wall 432 and is not necessarily confined to the bottom 434 of the hole.

Similarly the explosive 438 can be detonated, simultaneously with or separately from, the propellant 424 to give rise to a high energy localised effect which, again, causes rock breaking at a predetermined location.

It is apparent that the length of the cartridge, designated 450, is a factor which determines the quantity of propellant 424 which is initiated. This in turn determines the amount of energy which is released upon initiation. The quantity of energy which is released is a factor which determines the amount of rock which has broken free although, as is known in the art, many other factors come into play.

Thus the quantity and type of propellant used in the cartridge are taken into account in the light of the assessed rock characteristics. As noted the cartridge 416 is allowed to expand to confine the high pressure jet material, at least initially. The substantial base 418 is employed to direct the pressure wave radially downwardly at the bottom of the hole to initiate rock fracture. The discontinuity created by the ring 436 creates an intermediate high pressure zone which results in localised rock fracturing. A similar comment applies in respect of the explosive 438. It is therefore possible, at least to a considerable extent, to predetermine the point or points at which the rock will fracture and this can be used to control the amount of rock which is released upon initiation of the cartridge and the size of the resulting rock fragments.

Another variable which can be brought into effect is the use of two or more cartridges in a single hole. The first cartridge is positioned at the bottom of the hole and a second cartridge is loaded into the hole above stemming which is placed over the first cartridge. Initiation of both cartridges, substantially simultaneously, results in a greater degree of rock fragmentation and this results in generally smaller rock particles being produced.

The invention claimed is:

1. A method of breaking rock which includes the steps of:

(a) substantially filling a cartridge with a gas-evolving substance, the cartridge having a malleable wall and a base adapted to reinforce a wall and a bottom of a hole in the rock;

(b) loading and confining the cartridge in the hole;

(c) initiating a reaction of the gas-evolving substance and releasing a gas to cause the malleable wall and the base of the cartridge to simultaneously expand under pressure of the gas to the contours of its confinement and thus simultaneously reinforce the wall and the bottom of the hole, respectively; and (d) confining the gas within the cartridge, thus allowing a further build-up of pressure therein until rupture of the malleable wall and dislodgement of rock from the reinforced wall of the hole are achieved.

2. A method according to claim 1 wherein, in step (c), the cartridge is allowed to expand in a radial sense into sealing engagement with a wall of the hole surrounding the cartridge.

3. A method according to claim 1 wherein, in step (c), the cartridge is allowed to expand in a longitudinal direction of the hole into sealing engagement with the bottom of the hole.

4. A method according to claim 3 wherein the cartridge includes a base which is moved into intimate engagement with the bottom of the hole in which the cartridge is located, when the cartridge expands in the longitudinal direction.

5. A method according to claim 4 wherein an end of the cartridge which is remote from the base is surrounded by stemming and the end is caused to move into close contact with the stemming as the cartridge expands in the longitudinal direction.

6. A method according to claim 3 wherein the cartridge includes at least two portions which are allowed to move relatively to one another to allow the cartridge to expand in the longitudinal direction.

7. A method according to claim 1 wherein the cartridge has a rupture valve and a side wall, and said method includes the step of allowing the valve to rupture prior to the side wall whereby, at least initially, fracture of rock is initiated at a bottom of the hole.

8. A method according to claim 7 wherein the rupture valve is telescopically movable relative to the side wall thereby to expose open or weakened regions of the valve which allow pressurized material to escape from the cartridge before the side wall ruptures or breaks.

9. A method according to claim 1 which includes the steps of assessing characteristics of the rock, matching at least one parameter of the cartridge to the rock characteristics, and initiating the propellant to achieve a desired rock-breaking effect which is dependent on the at least one parameter.

10. A method according to claim 9 wherein the parameter includes at least one of the following: the nature or composition, of the propellant; the quantity of the propellant; the physical parameters of the cartridge, i.e. the material from which the cartridge is made, its shape and size; the ability of the cartridge or a component which is associated with the cartridge to deform a pressure wave which is generated upon initiation of the propellant; the use of high density material to produce high density jet material upon initiation of the propellant; and the inclusion or provision of discontinuities in the cartridge to create high stress concentration points.

11. Apparatus for breaking rock which includes a cartridge with a base and a wall which is made from a malleable material and which extends from the base, the base and the wall forming an enclosure, a propellant which substantially fills the enclosure, and means for igniting the propellant, thereby to produce pressurized material which expands the cartridge wherein the malleable material is at least capable of plastic deformation in a radial sense without rupturing by at least 10% so that the wall and the base of the cartridge, upon expansion, simultaneously reinforce a wall and a bottom of a hole in the rock in which the cartridge is located, wherein a weakened zone is formed at a junction of the wall and the base so that when the cartridge is internally pressurized the container ruptures initially at this junction.

12. Apparatus according to claim 11 wherein the propellant is selected from a propellant, a blasting agent, and a gas-evolving substance which, once initiated, generates high pressure combustion products at least partly in gaseous form.

13. Apparatus according to claim 11 wherein the cartridge has at least two portions forming an enclosure for the propellant, and wherein the portions are movable relatively to each other.

14. Apparatus according claim 13 wherein the cartridge is elongate and the portions are movable in a longitudinal direction relatively to each other.

15. Apparatus for breaking rock which includes a cartridge with a base and a wall which is made from a malleable material and which extends from the base, the base and the wall forming an enclosure, a propellant which substantially fills the enclosure, and means for igniting the propellant, thereby to produce pressurized material which expands the cartridge wherein the malleable material is at least capable of plastic deformation in a radial sense without rupturing by at least 10% so that the wall and the base of the cartridge, upon expansion, simultaneously reinforce a wall and a bottom of a hole in the rock in which the cartridge is located, wherein the cartridge includes a rupture valve and wherein pressurized material, released upon ignition of the propellant, is allowed to escape from the cartridge via the rupture valve, at least initially, prior to escaping through the side wall.

16. Apparatus according to claim 15 wherein the pressurized material escapes via the rupture valve at a region which is adjacent the base or which is initially occupied by at least part of the base.

17. Apparatus according to claim 15 wherein the rupture valve is telescopically engaged with the side wall.

18. Apparatus according to claim 15 wherein a friction zone or region, between the base and the side wall, is provided in the cartridge to facilitate rupture of the valve at a predetermined pressure, prior to rupture of the side wall.

19. Apparatus according to claim 18 wherein the cartridge includes vents to allow release of pressurized material once the valve has been extended sufficiently from within the confines of the side wall.

* * * * *